US009380845B2

(12) United States Patent
Sheikh et al.

(10) Patent No.: US 9,380,845 B2
(45) Date of Patent: Jul. 5, 2016

(54) LUGGAGE WITH WRAP AROUND DESIGN PANEL

(71) Applicants: Emran Sheikh, Mississauga (CA); Jia Yi Liang, Markham (CA)

(72) Inventors: Emran Sheikh, Mississauga (CA); Jia Yi Liang, Markham (CA)

(73) Assignee: Heys International Ltd., Mississauga (CA)

( * ) Notice: Subject to any disclaimer, the term of this patent is extended or adjusted under 35 U.S.C. 154(b) by 91 days.

(21) Appl. No.: 14/092,978

(22) Filed: Nov. 28, 2013

(65) Prior Publication Data

US 2015/0144449 A1 May 28, 2015

(51) Int. Cl.

| | |
|---|---|
| ***A45C 5/03*** | (2006.01) |
| *A45C 13/08* | (2006.01) |
| *A45C 13/42* | (2006.01) |

(52) U.S. Cl.

CPC . *A45C 5/03* (2013.01); *A45C 13/08* (2013.01); *A45C 13/42* (2013.01); *A45C 2005/037* (2013.01)

(58) Field of Classification Search

CPC ... A45C 13/08; A45C 13/42; A45C 2005/037
USPC ..... 190/125, 127; 150/105
See application file for complete search history.

(56) References Cited

U.S. PATENT DOCUMENTS

| | | | | |
|---|---|---|---|---|
| 3,623,580 | A * | 11/1971 | Toller | 190/115 |
| 4,350,546 | A * | 9/1982 | Davis | 156/93 |
| 4,370,590 | A * | 1/1983 | Webster | 313/391 |
| 6,173,857 | B1 * | 1/2001 | Olsson et al. | 220/608 |
| 8,028,730 | B2 * | 10/2011 | Whiting et al. | 150/104 |
| 8,636,122 | B2 * | 1/2014 | Smith et al. | 190/18 A |
| 9,066,566 | B2 * | 6/2015 | Lai | |
| 2006/0037826 | A1 * | 2/2006 | Duncanson et al. | 190/124 |
| 2006/0201764 | A1 * | 9/2006 | Morszeck | 190/125 |
| 2007/0137959 | A1 * | 6/2007 | Zauderer | 190/110 |
| 2007/0221461 | A1 * | 9/2007 | Carmona | 190/101 |
| 2009/0276089 | A1 | 11/2009 | Bartholomew | |
| 2011/0023299 | A1 * | 2/2011 | Chen et al. | 29/876 |
| 2011/0107629 | A1 | 5/2011 | Spiro | |
| 2012/0199594 | A1 | 8/2012 | Pernarella | |
| 2014/0183853 | A1 * | 7/2014 | Dziawer | 283/56 |

FOREIGN PATENT DOCUMENTS

| | | | |
|---|---|---|---|
| WO | WO 9626872 | * | 9/1996 |

* cited by examiner

*Primary Examiner* — Sue A Weaver
(74) *Attorney, Agent, or Firm* — Bereskin & Parr LLP/S.E.N.C.R.L., s.r.l.

(57) ABSTRACT

A hard-sided suitcase may include a first shell portion and a complimentary second shell portion connected to the first shell portion and movable between closed position in which the first and second shell portions enclose an interior of the suitcase and an open position permitting access to the interior. The first shell portion may have a first base wall and a first side wall meeting the first base wall at a first juncture. A first design panel may be coupled to the first shell portion. The first design panel covering at least a portion of the first base wall and the first side wall and extending across the first juncture.

19 Claims, 6 Drawing Sheets

LUGGAGE WITH WRAP AROUND DESIGN PANEL

FIELD

The present subject matter of the teachings described herein relates generally luggage with decorative design panels.

BACKGROUND

US 2011/0107629 (Spiro) discloses, according to one embodiment, a perforated card includes a plurality of separable components that includes a tag suitable for the inclusion of personal data such as an address. The tag includes an opening. The card also includes a strap that is separably attached to at least a portion of the tag. The strap is insertable through the opening of the tag and is configured to be fixedly attached about a handle of a piece of luggage. The tag may be formed from a lenticular material.

US 2009/0276089 (Bartholomew) discloses an apparatus and a method for dispensing a luggage recognition label having an RFID or GPS device associated therewith that allows a passenger and/or a passenger carrier to identify and track their luggage during travel, provide access to a secure network for storing customer information and travel information including a luggage inventory and itinerary information, and the ability to purchase travel insurance in association with the luggage recognition label. The label may include lenticular printing US 2012/0199594 (Pernarella) discloses a Unique Luggage identify tank top consists of pieces of material of one or more colors and/or designs connected together to create a tank top style garment to cover most of the luggage for quick and accurate identification and personalization of the luggage from the vast number of look alike luggage; it also serves to protect the luggage from accidentally opening; it is removable, reusable, washable, expandable, practical, functional, easy to care for and valued by minimizing the possibility of wrong claims. The Unique luggage identifying tank top allows users to update and personalize their existing or new luggage at minimal expense; also, permits users to instantly identify their luggage regardless of how it falls in the transportation belt by having the cover visible from any view of the luggage. The Unique luggage identifying tank serves to unify groups and as a traveling billboard for personal or commercial advertisement.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In accordance with one broad aspect of the teaching disclosed herein, a hard-sided suitcase may include a first shell portion and a complimentary second shell portion connected to the first shell portion and movable between closed position in which the first and second shell portions enclose an interior of the suitcase and an open position permitting access to the interior. The first shell portion may have a first base wall and a first side wall meeting the first base wall at a first juncture. A first design panel may be coupled to the first shell portion and may cover at least a portion of the first base wall and the first side wall and may extend across the first juncture.

The first design panel may be a passive, dynamic design panel that displays a first image when viewed from a first angle and a second image when viewed from a second angle.

The first design panel may include a lenticular display having a lenticular image covered with a corresponding lenticular lens assembly. The lenticular image and the lenticular lens assembly may extend across the first juncture.

The first juncture may extend in a first direction and the lenticular lens assembly may include an array of elongate lenses, each of which extends generally parallel to the first direction.

The suit elongate lenses in the array may be integrally molded in a one-piece, unitary plastic substrate extending across the first juncture.

The first shell portion may also include a second side wall opposite the first side wall and spaced apart from the first side wall in a second direction. The second side wall may meet the first base wall at a second juncture, and the first design panel may extend across the second juncture and cover at least a portion of the second side wall.

The first design panel may extend continuously between the first juncture and the second juncture.

The first juncture may extend in a first direction and the first side wall may extend in a second direction that is generally orthogonal the first direction from the first juncture to a distal edge. The first side wall may have a length in the first direction and a width in the second direction and the design panel may extend across substantially the entire width of the first side wall between the first juncture and the distal edge.

The design panel may have a length in the first direction that is less than the length of the first side wall, and the length of the design panel may be between about 20% and about 80% of the length of the first side wall.

The first design panel may include a peripheral edge and may be stitched to the first shell portion along at least a portion of the peripheral edge.

The first base wall may be generally planar and may lie in a first plane. The first side wall may be generally planar and may lie in a second plane that is generally orthogonal to the first plane.

The portion of the first base wall that is covered by the first design panel may be disposed between two exposed portions of the first base wall that are not covered by the first design panel.

The second shell portion may include a second base wall that is generally opposite the first base wall when the first shell portion is in the closed position and a third side wall meeting the second base wall at a third juncture. The suit case may include a second design panel coupled to the second shell portion and covering at least a portion of the second base wall and the third side wall and extending across the third juncture.

The second design panel may include a second lenticular display comprising a second lenticular image covered with a corresponding second lenticular lens assembly. The second lenticular image and the second lenticular lens assembly may extend across the third juncture.

The third juncture may extend in a first direction and the lenticular lens assembly may include an array of elongate lenses. Each elongate lens may extend generally parallel to the first direction.

The first juncture and the third juncture may extend in a first direction and are generally parallel to each other, and wherein the first design panel and the second design panel are generally aligned with each other in the first direction.

The first shell portion may include a second side wall opposite the first side wall and spaced apart from the first side wall in a second direction and meeting the first base wall at a second juncture and the first design panel may extend across the second juncture and cover at least a portion of the second side wall. The second shell portion may include a fourth side wall opposite the third side wall and spaced apart from the third side wall in the second direction and meeting the second base wall at a fourth juncture. The second design panel may extend across the fourth juncture and cover at least a portion of the second side wall.

The first design panel may wrap continuously around the first shell portion from a distal edge of the first side wall to a distal edge of the second side wall, and the second design panel may wrap continuously around the second shell portion from a distal edge of the third side wall to a distal edge of the fourth side wall.

DRAWINGS

The drawings included herewith are for illustrating various examples of articles, methods, and apparatuses of the teaching of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 2:
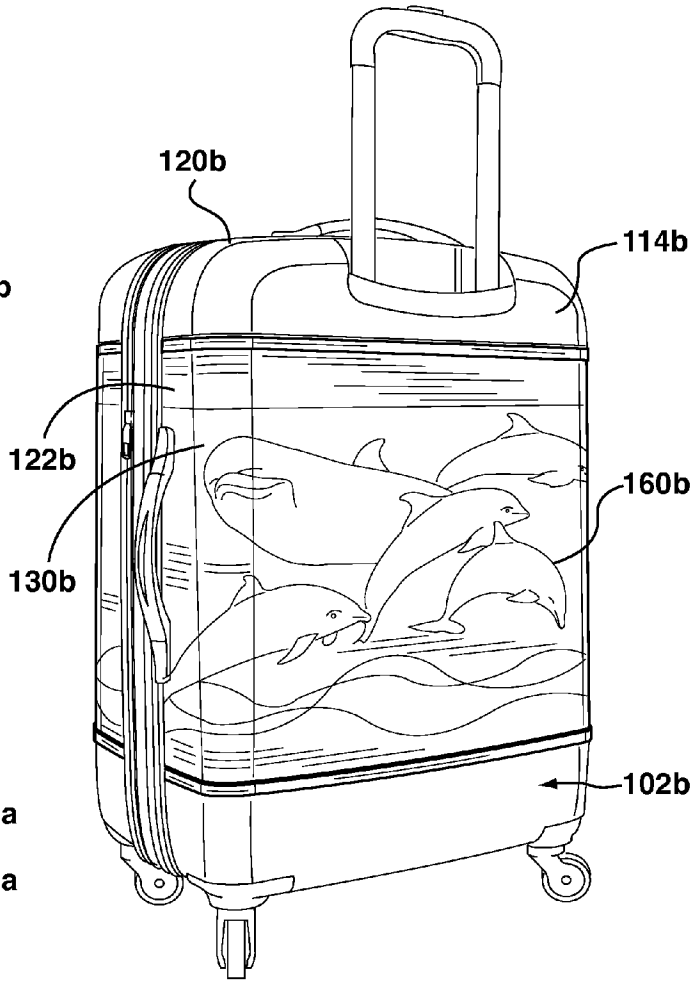
FIG. 2 is another perspective view of the suit case of FIG. 1.
Figure 1:
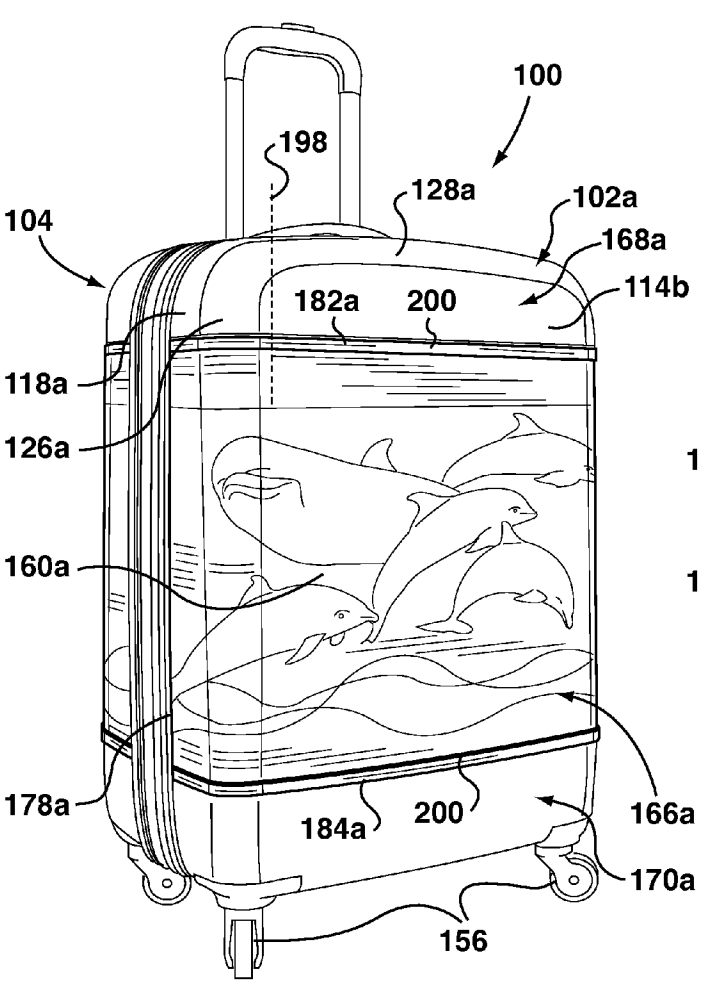
FIG. 1 is a perspective view of an embodiment of a suit case.

Referring to FIG. 1, an embodiment of a hard-sided suitcase 100 includes a first shell portion 102*a* and a complimentary second shell portion 102*b* connected to the first shell portion 102*a*. The first shell portion 102*a* is preferably movably connected to the second shell portion 102*b* so that the suit case 100 can be opened and closed.

Figure 5:
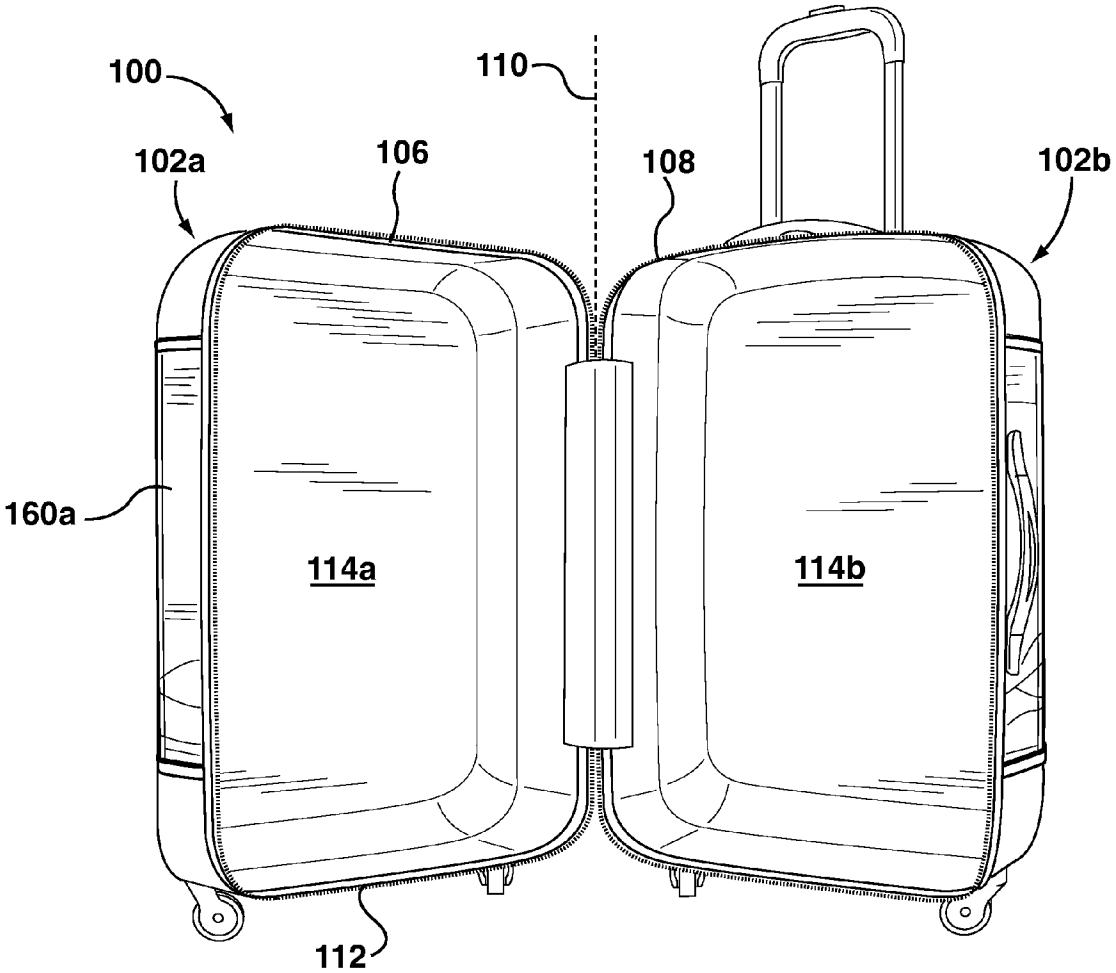
FIG. 5 is a perspective view of the suit case of FIG. 1 in an open configuration.

Referring also to FIG. 5, in the illustrated example, the first shell portion 102*a* includes a first rim portion 106 and the second shell portion 102*b* includes a complimentary second rim portion 108. The first shell portion 102*a* is hingedly connected to the second shell portion 102*b* along a portion of the first rim portion 106, and the first and second shell portions 102*a*, 102*b* can pivot relative to each other about the hinge axis 110. When the suit case 100 is closed, the first rim portion 106 abuts and is fastened to the second rim portion 108 to enclose an interior volume of the suit case 100. The suit case 100 may include any suitable fastening mechanism to keep the first shell portion 102*a* in the closed position, including for example a zipper, buckles, belts, latches and other fasteners. In the illustrated example, a zipper fastening mechanism 112 is used secure substantially the entire the first and second rim portions 106, 108 together.

The first and second shell portions 102*a*, 102*b* may be any suitable shape including rectangular, curved, cylindrical or other suitable shapes. In the illustrated example, the first shell portion 102*a* is generally rectangular and includes a generally planar base wall 114*a* that extends in a first plane 116 (FIG. 3), and four side walls 118*a*, 120*a*, 122*a*, and 124*a* that extend from the periphery of the base wall 114*a* and meet the base wall 114*a* at respective intersections or junctures 126*a*, 128*a*, 130*a* and 132*a*. Each side wall 118*a*, 120*a*, 122*a*, and 124*a* has a distal edge 134*a*, 136*a*, 138*a* and 140*a* that is spaced apart from the base wall 114*a* by a width 142*a* (FIG. 3) and, in the example illustrated, forms part of the rim 106 of the first shell portion 102*a*.

Figure 4:
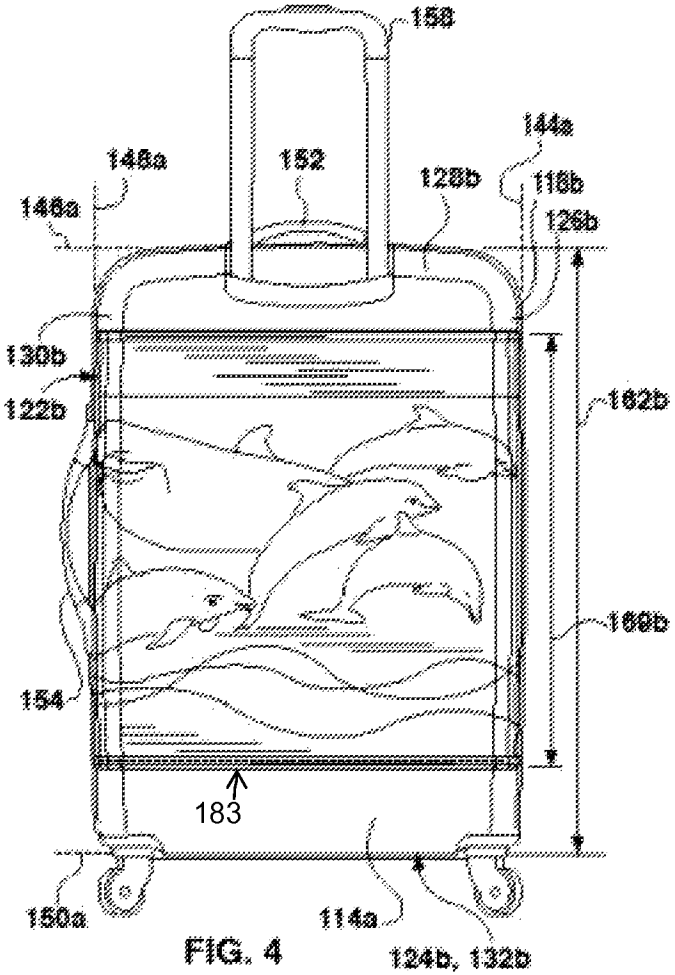
FIG. 4 is a front elevation view of the suit case of FIG. 1.

In the illustrated example, each of the side walls 118*a*, 120*a*, 122*a*, and 124*a* lies in a respective plane 144*a*, 146*a*, 148*a* and 150*a* (FIG. 4). In the example illustrated, the planes 144*a* and 148*a* are generally parallel to each other, the planes 146*a* and 150*a* are generally parallel to each other and each of the planes 144*a*, 146*a*, 148*a* and 150*a* are generally orthogonal to the plane 116 containing the base wall 114*a*. Alternatively, the planes 144*a*, 146*a*, 148*a* and 150*a* need not be orthogonal to plane 116, but can instead be at another angle to the plane 116 such that the shell generally tapers between the base wall 114*a* and the rim 106.

The junctures may be of any suitable configuration including, for example, relatively sharp corners, chamfers, fillets and curved or radiused corners. In the illustrated example, the junctures 126*a*, 128*a*, 130*a* and 132*a* are rounded corners. Providing rounded corners may help reduce stresses at the junctures, may help facilitate manufacturing of the first shell portion and/or may be desirable when the suit case is being handled by a user or by automated baggage handling equipment. For example, providing rounded edges and corners may help reduce the chances of the suit case being caught or jammed in automated luggage handling equipment (for example the baggage handling conveyor assemblies at airports, etc.) and may help reduce the chances of the suit case damaging surfaces or objects it contacts. Rounded corners may also contribute to the overall aesthetic appearance of the suit case.

In the illustrated example, the second shell portion 102*b* is generally analogous to the first shell portion 102*a*, and like features are illustrated using like reference characters with a "b" suffix. Alternatively, the first and second shell portions may have different configurations. For example, one of the first and second shell portions may be provided as a generally planar lid-type member that consists essentially of a base wall that can be coupled to the rim of the other shell portion, without side walls.

Optionally, the suit case may include one or more handles, straps, wheels, expansion panels, support feet or other features to help facilitate carrying, transporting and handling of the suit case. Referring to FIG. 4, in the illustrated example the suit case 100 includes an upper carrying handle 152 disposed on the side wall 120*b* and a secondary carrying handle 154 disposed on the side wall 122*b*. The carrying handles 152 and 154 may be of any suitable configuration.

In the illustrated example, the suit case 100 also includes four supporting wheels 156 positioned on the side walls 128*a* and 128*b* to rolling support the suit case 100 on a surface. While illustrated with four wheels 156, the suit case 100 could alternatively be configured to have more wheels, fewer wheels (e.g. 2 wheels) or no wheels at all. The illustrated embodiment also includes an extendable handle assembly 158 that may help a user manipulate and steer the suit case 100 while it is rolling on its wheels 156. Optionally, the extendable handle 158 can be retracted for storage. In the illustrated example the handle is generally adjacent the base wall 114*b* and can retract within the second shell portion 102*b*.

Each shell portion 102*a* and 102*b* may be formed from any suitable material, including for example plastics and composite materials. Optionally, the outer surface of each shell portion may be formed as a unitary, one-piece member. Alternatively, either or both of the shell portions may be formed from a plurality of different panels which are joined together using any suitable fastening mechanism, including, for example, adhesives, welding, stitching, zippers and other suitable means.

Sometimes when a suit case is in use it can be separated from its owner, and it is then necessary for the owner to recognize and claim the suit case at a later time. For example, when travelling with a commercial airline it is common for a traveler to check one or more suit cases at the airline counter to be loaded into a baggage compartment of the airplane along with suit cases from other travelers. When the plane reaches its destination suit cases from the baggage compartment are unloaded by a ground crew and provided on a luggage conveyor or luggage carousel for collection. The traveler then visually examines multiple suit cases on the luggage conveyor and attempts to identify and collect his/her suit case from amongst the others. A similar inspection may take place if the suit case were loaded on to a ground vehicle (such as a bus or a train) or stored in a common storage location with other suit cases.

To help identify his/her specific suit case, a traveler may look for an identifying visual marker that is unique to his/her suit case or is at least recognizable (i.e. the marker need not be absolutely unique). One example of such a marker is a known luggage tag that can be affixed to the handle or other portion of a suit case. Luggage tags come in a variety of colours and designs and can be provided with a travelers, name and contact information. Conventional luggage tags have some shortcomings, such as the fact that the tags may become damaged or separated from a suit case during transit or handling. Further, luggage tags connected to handles or other features on a suit case are only visible when the feature they are attached to is exposed/visible. For example, a luggage tag attached to a handle that is provided on one side wall of a suit case will not be visible if the corresponding side wall is not visible (i.e. if the side wall is facing away from the traveler, is "face down" or is covered or blocked by another piece of luggage). If a luggage tag is not immediately visible a traveler may have to move to a new vantage point to survey the plurality of suit cases or may have to move, re-orient or otherwise handle the suit cases in order to expose the luggage tags.

One alternative to luggage tags are stickers, labels or other types of surface designs that are provided on faces of the suit case. Conventional stickers are typically relatively small and are contained on one face of the suit case. Accordingly, the use of stickers as an identifying means may also be frustrated if the surface to which the sticker is attached is not exposed or visible to the traveler. Applying stickers to multiple surfaces of a suit case may help reduce the chances that all of the stickers will be blocked from view in a given orientation of the suit case, but would require a traveler to affix multiple recognizable stickers to a given suit case (e.g. at least 6 for a generally rectangular suit case). Also, as stickers are typically relatively smaller than the surfaces they are affixed to, a sticker on a surface of a suit case may be blocked by another piece of luggage or other obstacle even if the surface is otherwise not obstructed. Further, stickers and labels may tend to be damaged or scraped off during handling of the suit case.

Other alternatives to mark suit cases may include providing the suit case in a somewhat uncommon, recognizable colour (such as red, green, etc.) instead of more common colours (such as black and grey). In addition, some suit cases have been decorated with a generally continuous pattern over most or all of their exposed surfaces (eg. an animal print, flowers, plaid design, etc.) to help visually distinguish them other suit cases.

Further, conventional luggage tags, stickers and surface colours/patterns on suit cases tend to be static visual markers. That is, the appearance of the visual makers remains substantially the same regardless of the position of an observer relative to the visual marker.

Optionally, instead of or in addition to, one or more of the conventional visual markers, a suit case may be provided with a visual marker in the form of a design panel as described herein. The design panel may include one or more features that may affect the aesthetic appearance of a suit case and/or may make it easier for a user to visually locate a target suit case from amongst a plurality of other suit cases that do not have such a design panel, or have panels with different designs.

For example, the design panel may be configured to extend around a corner/juncture and to cover at least a portion of two or more surfaces of the suit case. Providing a design panel that extends across a juncture may help enable the design panel to remain exposed even if one of the surfaces it covers is blocked or is facing the ground/conveyor belt. Optionally, the design panel may extend across more than one juncture and may substantially wrap around an entire shell portion of a suit case. If both shell portions of a suit case are provided with similar design panels, when the suit case is closed the design panel may appear to wrap around the entire suit case. In this configuration, at least a portion of the design panel may remain exposed regardless of which surface of the suit case is resting on the ground.

Optionally, the design panel may be configured to include a dynamic design feature that can change in visual appearance. For example, the design panel may be configured such that it has a first appearance when viewed from a first angle, and a different, second appearance when viewed from a second angle. One example of such a design panel is a lenticular design panel that includes a lenticular image covered by a lenticular lens assembly. The lenticular design panel can be configured such that it displays a first design when viewed from a first angle, and a second design when viewed from a second angle. Further, the lenticular design panel can be configured so that the visible design will alternate between the first and second design as the relative angle of observation of a user changes in a constant direction. For example, the lenticular design panel can be configured so that the displayed image will alternate between the first and second designs as the angle of observation moves from about 0 degrees to about 180 degrees (or from between about 10 degrees and about 170 degrees) relative to the design panel.

Providing a visual marker that can change in visual appearance may help bring the suit case to a user's attention, particularly, for example, if the suit case is moving relative to the user (of vice versa). For example if a suit case is moving on a luggage conveyor relative to a traveler, the relative observation angle between the observer/traveler and the suit case can change. As the observation angle changes, the visible image in the lenticular design panel can alternate between the first and second design. If the first and second designs are different, the changes in the visible design on the panel will appear to be a dynamic, changing display. Much like a flashing light may tend to attract an observer's attention, the dynamic changing of the image on the display panel may tend to attract the traveler's attention and distinguish the target suit case from amongst the plurality of surrounding suit cases with static visual markers. The alternating nature of a lenticular design panel may also be observable in a traveler's peripheral vision.

A lenticular design panel can provide the dynamic visual markers described above through the use of a static image and a static lenticular lens assembly. As such, it may be considered to be a passive type of dynamic design panel. For example, the lenticular panel does not have moving parts or components and need not be provided with electrical power and does not include replaceable or serviceable parts. In contrast, a flashing light source would require a power source and related electrical circuitry. Such an electrical system could be vulnerable to damage (a broken light blub, etc.) and may require periodic maintenance (replacing batteries). Further, suit cases with onboard electrical systems may be subjected heightened scrutiny when used in relatively high security travel facilities, such as airports.

While the above example relates to a stationary observer and a moving suit case, similar effects may be produced if the suit case is stationary and the observer is moving (e.g. a user walking around a group of static suit cases) and/or if both the suit case and observer are moving (e.g. a user walking around a moving airport luggage carousel).

Referring to FIG. 1, in the illustrated embodiment the suit case 100 includes a first design panel 160*a* coupled to the first shell portion 102*a* and a second design panel 160*b* coupled to the second shell portion 102*b*. In the example illustrated the design panels 160*a* and 160*b* are generally identical and are generally vertically aligned with each other. In this configuration, the designs panels 160*a* and 160*b* may give the appearance of a generally continuous band that wraps around the entire suit case 100 in the lateral direction. Features of the first design panel 160*a* will be explained in greater detail below, and it is understood that the second design panel 160*b* may include some or all of the same features.

Referring to FIG. 1, in the illustrated example the design panel 160*a* is a passive, dynamic design panel that displays a first image when viewed from a first angle, and a second image when viewed from a second angle. The design panel 160*a* is configured to that it covers a portion of the base wall 114*a* and of sidewalls 118*a* and 122*a* and wraps around junctures 126*a* and 130*a*.

Figure 3:
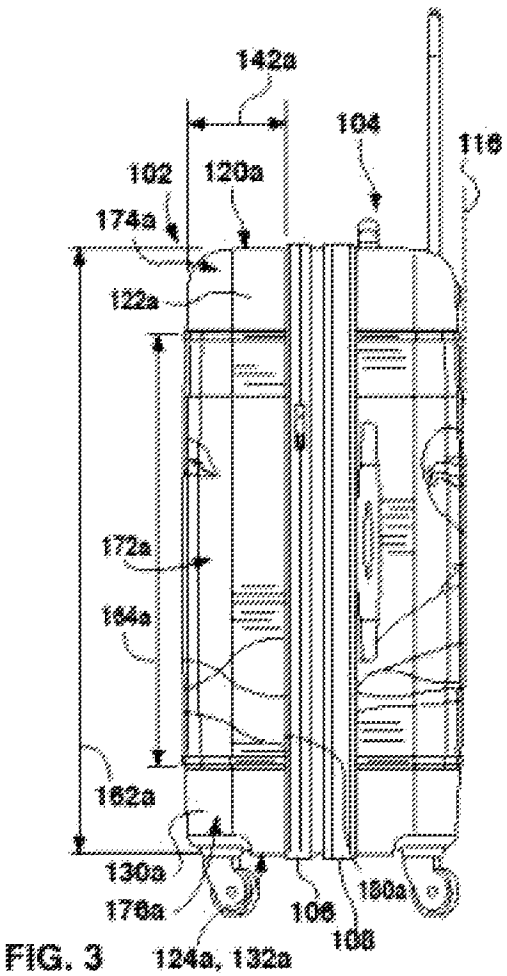
FIG. 3 is a side elevation view of the suit case of FIG. 1.

In the illustrated example, the design panel 160*a* is sized so that it covers only a portion of the base wall 114*a* and side walls 118*a* and 122*a*. Referring to FIG. 3, in the illustrated embodiment the base wall 114*a* and side walls 118*a* and 122*a* have a length 162*a* in the vertical direction (as illustrated) and the design panel 160*a* has vertical length 164*a* that is less than the length 162*a*. Optionally, the length 164*a* of the design panel 160*a* can be between about 20% and about 80% of the length 162*a* of the base wall 114*a*, and optionally may be between about 50% and 75% and about 55% and 70% of the length 162*a*. In the illustrated example, the length 164*a* is about 70% of the length 162*a*. Alternatively, the length 164*a* may be less than 30% of the length 162*a*.

Optionally, the design panel 160*a* can be located so that it is spaced apart from the end regions of the base wall 114*a* and optionally, may be generally, vertically centered on the base wall 114*a* (as illustrated). In this configuration, the base wall 114*a* may comprise a covered portion 166*a* that is covered by the design panel 160*a*, and first and second exposed portions 168*a* and 170*a* that are not covered by the design panel 160*a*. The side walls 118*a* and 122*a* may also have corresponding covered portions 172*a* and exposed portions 174*a* and 176*a* disposed on opposite sides of the display panel 160*a*. Positioning the design panel 160*a* inboard from the side walls 120*a* and 124*a* (at the top and the bottom of the suit case as illustrated in FIGS. 1 and 3) of the first shell portion 102*a* may help shield the design panel 160*a* from damage. The illustrated configuration may also allow the static exposed portions 168*a* and 170*a* to provide contrast the dynamic design panel 160*a*, which may help visually emphasize the design panel 160*a*. Optionally, the first and second shell portions may be formed from a plurality of separate panels, instead of an integral, one-piece construction. For example, the covered portions 166*a* and 172*a* may be formed from one panel, the exposed portions 168*a* and 174*a* may be another panel joined to the covered portions and the exposed portions 170*a* and 176*a* may be another panel joined to the covered portions. In such a configuration, the front shell portion 102*a* may be formed from three separate panels. In this configuration, the design panel 160*a* may also provide some structural support to the suit case. Optionally, a common attachment mechanism (e.g. stitching) may be used attach the design panel 160*a* and the shell panels together.

Referring to FIGS. 1 and 3, in the illustrated example the design panel has a first end edge 178*a*, a second end edge 180*a* spaced apart from the first end edge 178*a* and a pair of side edges 182*a* and 184*a* extending between the first and second end edges 178*a* and 180*a* and wrapping around the junctures 126*a* and 130*a*. In the illustrated example, the first end edge 178*a* of the design panel 160*a* is disposed adjacent the distal edge of the side wall 118*a*, and the second end edge 180*a* is disposed adjacent the distal edge of the side wall 122*a*. Alternatively, the end edges 178*a* and 180*a* of the design panel 160*a* need not be adjacent the distal edges of the side walls 118*a* and 122*a*, and the design panel 160*a* need not extend across the entire width of each side wall 118*a* and 122*a*.

In the illustrated embodiment, the design panel 160*a* extends generally continuously between the junctures 126*a* and 130*a*. Alternatively, the design panel 160*a* need not extend continuously across the base wall 114*a*, between junctures 126*a* and 130*a*. Optionally, the design panel 160*a* may include two or more separate, discrete sections that co-operate to provide a desired visual appearance. For example, the design panel may include a first section that extends across the juncture and covers at least a portion of the first side wall and at least a portion of the base wall, and a second section that extends across the juncture and covers at least a portion of the second side wall and at least a portion of the base wall.

While the design panel 160*a* may be any suitable type of passive, dynamic design panel, in the illustrated example the design panel includes a lenticular display 190 comprising a lenticular image covered with a corresponding lenticular lens assembly, and both the lenticular image and the lenticular lens assembly extend generally continuously across the first juncture.

Figure 6:
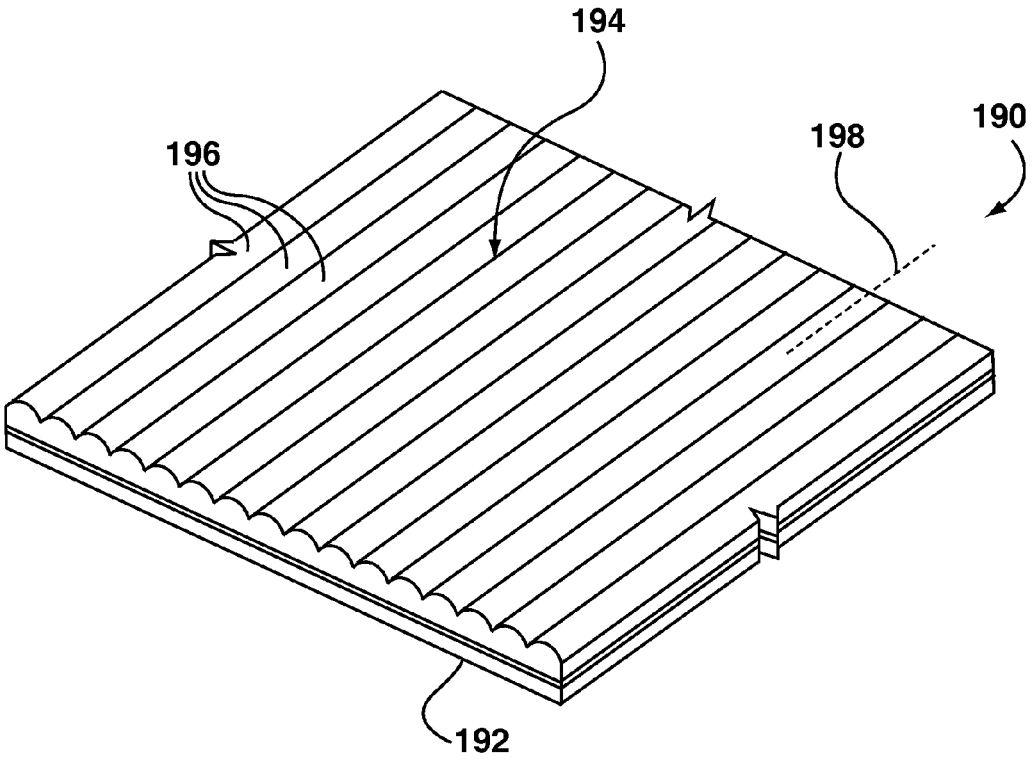
FIG. 6 is a schematic view of a portion of a lenticular design panel.
Figure 8:
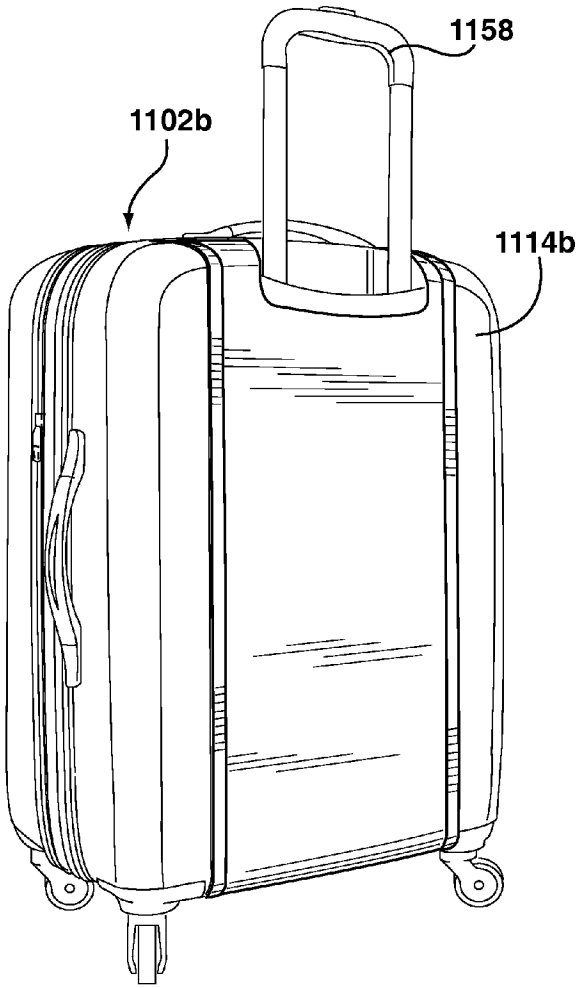
FIG. 8 is another perspective view of the suit case of FIG. 7.

Referring to FIG. 6, a schematic representation of the lenticular display 190 illustrates a lenticular image 192 and a lens assembly 194 that includes an array of elongate lenses 196. Optionally, the lens assembly 194 may be an integrally molded, one-piece unitary member, and may be formed from plastic. The lenses 196 in the assembly each extend in the direction of a lens axis 198. In the illustrated example, the design panel 160*a* is oriented so that the lens axis 198 is generally parallel to the direction the junctures 126*a* and 130*a* extend (see FIG. 1). In this configuration, the lenticular lens assembly 194 can be wrapped around the junctures 126*a* and 130*a* by bending the array between adjacent lenses 196, as opposed to having to bend each lens 196 in the axial direction.

The design panel 160*a* may be affixed to the first shell portion using any suitable means, including, for example glue, chemical adhesives and mechanical attachment members. In the illustrated example, the side edges 182*a* and 184*a* of the design panel 160*a* are stitched to the first shell portion 102*a*. In this configuration, the side edges 182*a* and 184*a* of the design panel 160*a* can be provided with fabric cover strips 200 that covers the side edge face of the design panel 160*a*. Providing cover strips 200 may alter the visual appearance of the design panel 160*a* and may help protect the side edge face of the design panel 160*a* from damage. The stitching 183 (FIG. 4) used to secure the design panel 160*a* to the first shell portion 102*a* can be positioned so that the thread forming the stitches engages the cover strips 200, the lenticular image 192 and the lenticular lens assembly 194. Alternatively, the stitching can be positioned so that the thread does not pass through at least one of the lenticular image 192 and lenticular lens assembly 194. Passing the thread through the lenticular lens assembly 194 may help improve the strength of the connection between the design panel 160*a* and the first shell portion 102*a*, however avoiding the lenticular lens array 194 may reduce the wear on the sewing equipment.

Optionally, one or more of component of the suit case 100 may overlap a portion of the design panels. For example, the side carry handle 156 may overlie a portion of the design panel 160*b*, and may be fastened to the second shell portion 102*b* using fasteners that also engage the design panel 160*b*.

Figure 7:
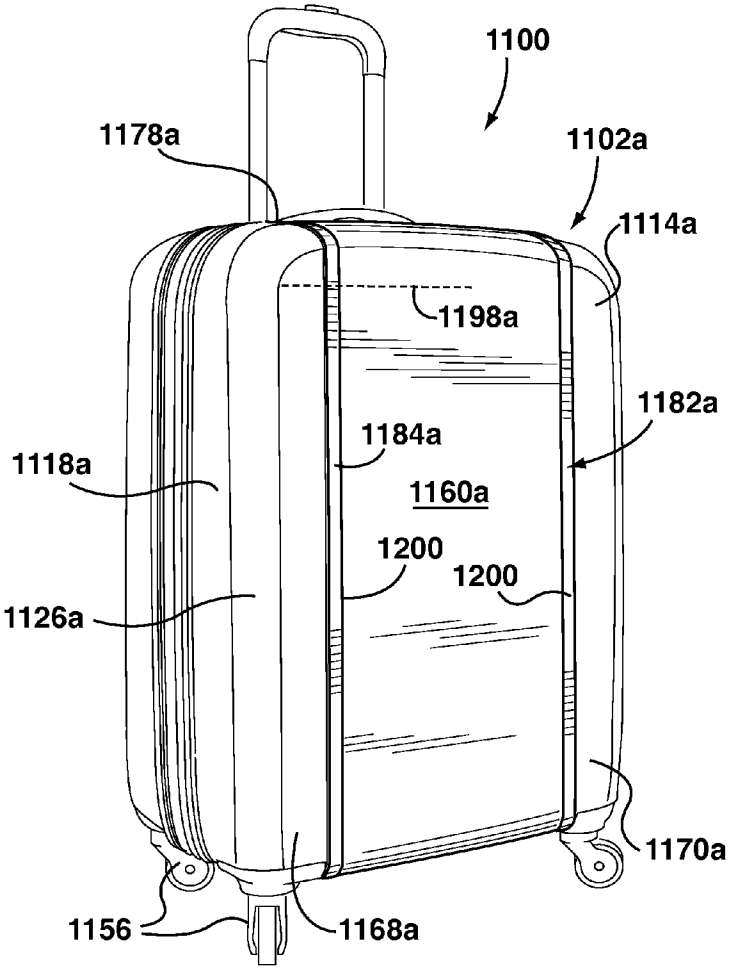
FIG. 7 is a perspective view of another embodiment of a suit case.
Figure 9:
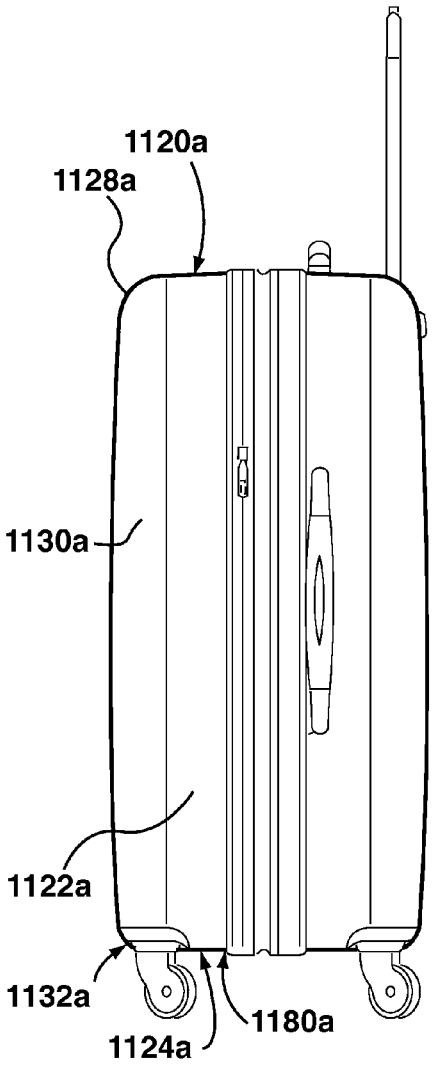
FIG. 9 is a side elevation view of the suit case of FIG. 7.
Figure 10:
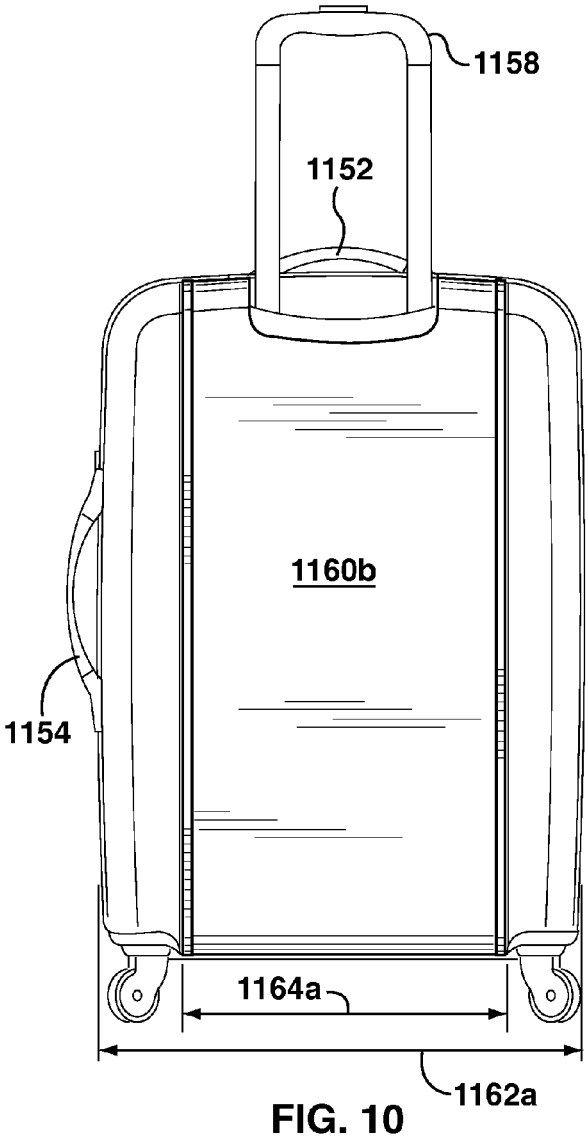
FIG. 10 is a front elevation view of the suit case of FIG. 7.

Referring to FIG. 7, another embodiment of a suit case 1100 is illustrated. The suit case is generally similar to the suit case 100, and like features are identified using like reference characters indexed by 1000. In this embodiment, the suit case 1100 includes generally vertically oriented design panels 1160*a* and 1160*b*, as opposed to the generally horizontal design panels 160*a* and 160*b* shown in FIGS. 1-4. In this configuration, exposed portions of the base walls extend generally vertically (as illustrated). The design panels 1160*a* and 1160*b* may be generally identical to the design panels 160*a* and 160*b*.

While the directions vertical and horizontal have been referenced herein for convenience, such directions are not intended to be limiting, and a feature that is described as being "vertical" may be horizontal or aligned in some other orientation in some embodiments of a suit case.

While the suit cases 100 and 1100 are shown having design panels on both the first and second shell portions, alternatively the suit case may only include a design panel on the first shell portion, or only on the second shell portion.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hard-sided suitcase comprising:

a) a first shell portion;

b) a complimentary second shell portion connected to the first shell portion and movable between a closed position in which the first and second shell portions enclose an interior of the suitcase and an open position permitting access to the interior;

c) the first shell portion having a first base wall and a first side wall meeting the first base wall at a first juncture;

d) a first design panel coupled to the first shell portion, the first design panel covering at least a portion of an external surface of the first base wall and an external surface of the first side wall and extending across the first juncture.

2. The suit case of claim 1, wherein the first design panel is a passive, dynamic design panel that displays a first image when viewed from a first angle and a second image when viewed from a second angle.

3. The suit case of claim 1, wherein the first shell portion comprises a second side wall opposite the first side wall and spaced apart from the first side wall in a second direction and meeting the first base wall at a second juncture, and wherein the first design panel extends across the second juncture and covers at least a portion of the second side wall.

4. The suit case of claim 3, wherein the first design panel extends continuously between the first juncture and the second juncture.

5. The suit case of claim 3, wherein the first juncture extends in a first direction and the first side wall extends in a second direction that is generally orthogonal the first direction from the first juncture to a distal edge, the first side wall having a length in the first direction and a width in the second direction and wherein the design panel extends across substantially the entire width of the first side wall between the first juncture and the distal edge.

6. The suit case of claim 5, wherein the design panel has a length in the first direction that is less than the length of the first side wall.

7. The suit case of claim 6, wherein the length of the design panel is between about 20% and about 80% of the length of the first side wall.

8. The suit case of claim 1, wherein the first design panel comprises a peripheral edge and is stitched to the first shell portion along at least a portion of the peripheral edge.

9. The suit case of claim 1, wherein the first base wall is generally planar and lies in a first plane and the first side wall is generally planar and lies in a second plane that is generally orthogonal to the first plane.

10. The suit case of claim 1, wherein the portion of the first base wall that is covered by the first design panel is disposed between two exposed portions of the first base wall that are not covered by the first design panel.

11. The suit case of claim 1, wherein the second shell portion further comprises a second base wall that is generally opposite the first base wall when the first shell portion is in the closed position and a third side wall meeting the second base wall at a third juncture, and wherein the suit case comprises a second design panel coupled to the second shell portion, the second design panel covering at least a portion of the second base wall and the third side wall and extending across the third juncture.

12. The suit case of claim 11, wherein the second design panel includes a second lenticular display comprising a second lenticular image covered with a corresponding second lenticular lens assembly, and wherein the second lenticular image and the second lenticular lens assembly extend across the third juncture.

13. The suit case of claim 12, wherein the third juncture extends in a first direction and wherein the lenticular lens assembly comprises an array of elongate lenses, each elongate lens extending generally parallel to the first direction.

14. The suit case of claim 11, wherein the first juncture and the third juncture extend in a first direction and are generally parallel to each other, and wherein the first design panel and the second design panel are generally aligned with each other in the first direction.

15. The suit case of claim 14, wherein the first shell portion comprises a second side wall opposite the first side wall and spaced apart from the first side wall in a second direction and meeting the first base wall at a second juncture, and the first design panel extends across the second juncture and covers at least a portion of the second side wall, and wherein the second shell portion comprises a fourth side wall opposite the third side wall and spaced apart from the third side wall in the second direction and meeting the second base wall at a fourth juncture, and the second design panel extends across the fourth juncture and covers at least a portion of the second side wall.

16. The suit case of claim 15, wherein the first design panel wraps continuously around the first shell portion from a distal edge of the first side wall to a distal edge of the second side wall, and the second design panel wraps continuously around the second shell portion from a distal edge of the third side wall to a distal edge of the fourth side wall.

17. A hard-sided suitcase comprising:

a) a first shell portion;

b) a complimentary second shell portion connected to the first shell portion and movable between a closed position in which the first and second shell portions enclose an interior of the suitcase and an open position permitting access to the interior;

c) the first shell portion having a first base wall and a first side wall meeting the first base wall at a first juncture;

d) a first design panel co pled to the first shell portion, the first design panel covering at least a portion of the first base wall and the first side wall and extending across the first juncture, wherein the first design panel is a passive, dynamic design panel that displays a first image when viewed from a first angle and a second image when viewed from a second angle and comprises a lenticular display comprising a lenticular image covered with a corresponding lenticular lens assembly, and wherein the lenticular image and the lenticular lens assembly extend across the first juncture.

18. The suit case of claim 17, wherein the first juncture extends in a first direction and wherein the lenticular lens assembly comprises an array of elongate lenses, each elongate lens extending generally parallel to the first direction.

19. The suit case of claim 18, wherein the elongate lenses in the array are integrally molded in a one-piece, unitary substrate extending across the first juncture.

* * * * *